US009138060B2

(12) United States Patent
Vainberg et al.

(10) Patent No.: US 9,138,060 B2
(45) Date of Patent: Sep. 22, 2015

(54) CUSHION COVERS, CUSHIONS, AND METHODS OF USING THE SAME

(71) Applicant: Red Star Traders, LLC, Salt Lake City, UT (US)

(72) Inventors: Lenny Vainberg, Mission Viejo, CA (US); William G. Apgood, Holladay, UT (US); William G. Apgood, II, Holladay, UT (US)

(73) Assignee: Red Star Traders, LLC, Salt Lake City, UT (US)

( * ) Notice: Subject to any disclaimer, the term of this patent is extended or adjusted under 35 U.S.C. 154(b) by 53 days.

(21) Appl. No.: 13/672,533

(22) Filed: Nov. 8, 2012

(65) Prior Publication Data

US 2014/0125098 A1 May 8, 2014

(51) Int. Cl.

| | |
|---|---|
| ***A47C 31/00*** | (2006.01) |
| ***A47C 7/02*** | (2006.01) |
| ***A47C 31/11*** | (2006.01) |

(52) U.S. Cl.

CPC ..... *A47C 7/021* (2013.01); *A47C 31/116* (2013.01); *Y10T 29/49826* (2015.01)

(58) Field of Classification Search

CPC ..... A47C 7/021; A47C 7/18; A47C 7/24; A47C 31/10; A47C 31/11; A47C 31/113

USPC ..... 297/219.1, 228.11, 228.12, 228.13

See application file for complete search history.

(56) References Cited

U.S. PATENT DOCUMENTS

| | | | | |
|---|---|---|---|---|
| 3,856,611 | A * | 12/1974 | Markley | 428/76 |
| 4,961,982 | A * | 10/1990 | Taylor | 428/91 |
| 6,652,027 | B1 * | 11/2003 | Pardonnet | 297/230.12 |
| 6,859,962 | B2 * | 3/2005 | Diak/Ghanem | 5/499 |
| 7,128,371 | B2 * | 10/2006 | Kawasaki et al. | 297/284.2 |
| 7,819,484 | B2 * | 10/2010 | Conforti | 297/452.21 |
| 8,082,612 | B2 * | 12/2011 | Saunders | 5/499 |

* cited by examiner

*Primary Examiner* — Philip Gabler
(74) *Attorney, Agent, or Firm* — Workman Nydegger

(57) ABSTRACT

Cushion covers, cushions, and methods of using the same are disclosed. In an embodiment, a cushion may include a cushion insert having a bottom face including a plurality of through openings. The cushion may further include a cushion cover having a top portion, a bottom portion, one or more side portions, and an interior space at least partially defined there between. The cushion insert may be selectively received and housed in the interior space. The cushion cover may also include a bottom opening positioned in the bottom portion. The bottom opening may expose one or more of the through openings to an area external to the cushion cover. The bottom opening and the through openings may collectively be configured to promote drying and/or draining of the cushion insert by allowing passage of air and/or water between the cushion insert and the area external to the cushion cover.

11 Claims, 16 Drawing Sheets

CUSHION COVERS, CUSHIONS, AND METHODS OF USING THE SAME

BACKGROUND

Furniture is used in homes, offices, schools, churches, backyards, on porches, decks, patios, etc. Cushions are commonly provided with furniture to make the furniture more comfortable. However, cushions are notoriously susceptible to stains and/or damage from spills, pets, dirt, water, sun, rain, and/or the like. Moreover, cleaning a cushion in a washing machine can be problematic because it can often result in a volume reduction and/or change of shape so that in the washed state the cushion no longer has an attractive appearance. In addition, when tastes, trends, or fashions change, the purchase of new cushions can be expensive and complicated. Further, if a cushion is ruined by snow or spilled wine, it may be difficult to find a replacement cushion having the right shape and size to match a particular piece of furniture.

Therefore, manufacturers and users of cushions continue to seek improved cushion designs and methods of use.

SUMMARY

Cushion covers, cushions, and methods of using the same are disclosed. In an embodiment, a cushion cover may include a top portion, a bottom portion spaced from the top portion, and one or more side portions extending between the top portion and the bottom portion. The cushion cover may further include an interior space at least partially defined between the top portion, the bottom portion, and the one or more side portions. The interior space may be configured to selectively receive and house a cushion insert having a bottom face. The cushion cover may further include a bottom opening positioned in the bottom portion. The bottom portion may include one or more outer edge portions connected to the one or more side portions and one or more inner edge portions at least partially defining the bottom opening. The bottom opening may be configured to promote drying and/or draining of the cushion insert by exposing at least a portion of the bottom face of the cushion insert to an area external to the cushion cover when the cushion insert is positioned within the interior space.

In an embodiment, a cushion may include a cushion insert having a bottom face including an interior surface, an exterior surface, and a plurality of through openings extending between the interior surface and the exterior surface. One or more of the through holes may exhibit a lateral opening dimension configured to allow passage of air and/or water between the interior surface and the exterior surface. The cushion may further include a cushion cover having a top portion and a bottom portion. One or more side portions may extend between the top portion and the bottom portion. The cushion cover may further include an interior space at least partially defined between the top portion, the bottom portion, and the one or more side portions. The cushion insert may be selectively received and housed in the interior space. The cushion cover may also include a bottom opening positioned in the bottom portion of the cushion cover. The bottom opening may expose one or more of the through openings to an area external to the cushion cover. The bottom opening and the through openings may collectively be configured to promote drying and/or draining of the cushion insert by allowing passage of air and/or water between the cushion insert and the area external to the cushion cover.

In an embodiment, a method assembling a cushion may include providing a cushion insert having a bottom face having a plurality of through openings. The method may further include positioning the cushion insert inside a cushion cover. The cushion cover may include a top portion, a bottom portion spaced from the top portion, and one or more side portions extending between the top portion and the bottom portion. The cushion cover may further include an interior space at least partially defined between the top portion, the bottom portion, and the one or more side portions. The cushion insert may be positioned within the interior space. The cushion cover may further include a bottom opening formed in the bottom portion of the cushion cover. At least a portion of the through openings of the cushion insert may be exposed to an area external to the cushion cover through the bottom opening.

Features from any of the disclosed embodiments may be used in combination with one another without limitation. In addition, other features and advantages of the present disclosure will become apparent to those of ordinary skill in the art through consideration of the following detailed description and the accompanying drawings.

BRIEF DESCRIPTION OF THE DRAWINGS

To further clarify at least some of the advantages and features of the present disclosure, a more particular description of the disclosure will be rendered by reference to specific embodiments thereof which are illustrated in the appended drawings. It is appreciated that these drawings depict only illustrated embodiments of the disclosure and are therefore not to be considered limiting of its scope. The disclosure will be described and explained with additional specificity and detail through the use of the accompanying drawings in which.

Figure 1:
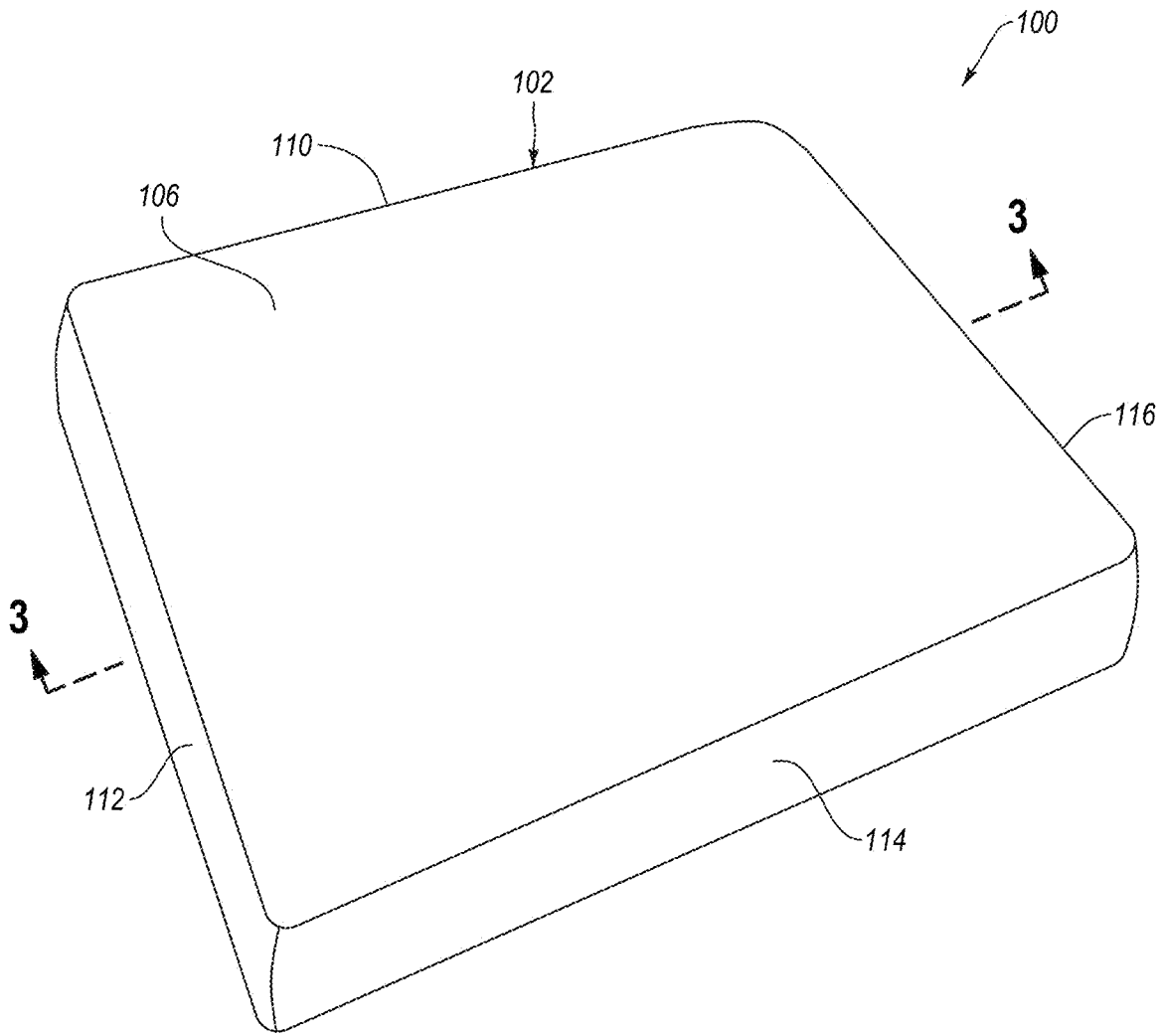
FIG. 1 illustrates a top perspective view of a cushion according to an embodiment.

It should be noted that the figures are not drawn to scale and that elements of similar structures or functions are generally represented by like reference numerals for illustrative purposes throughout the figures. It also should be noted that the figures are only intended to facilitate the description of example configurations of the present disclosure.

DETAILED DESCRIPTION

Embodiments of the invention generally relate cushion covers, cushions, and methods of using the same.

Figure 2:
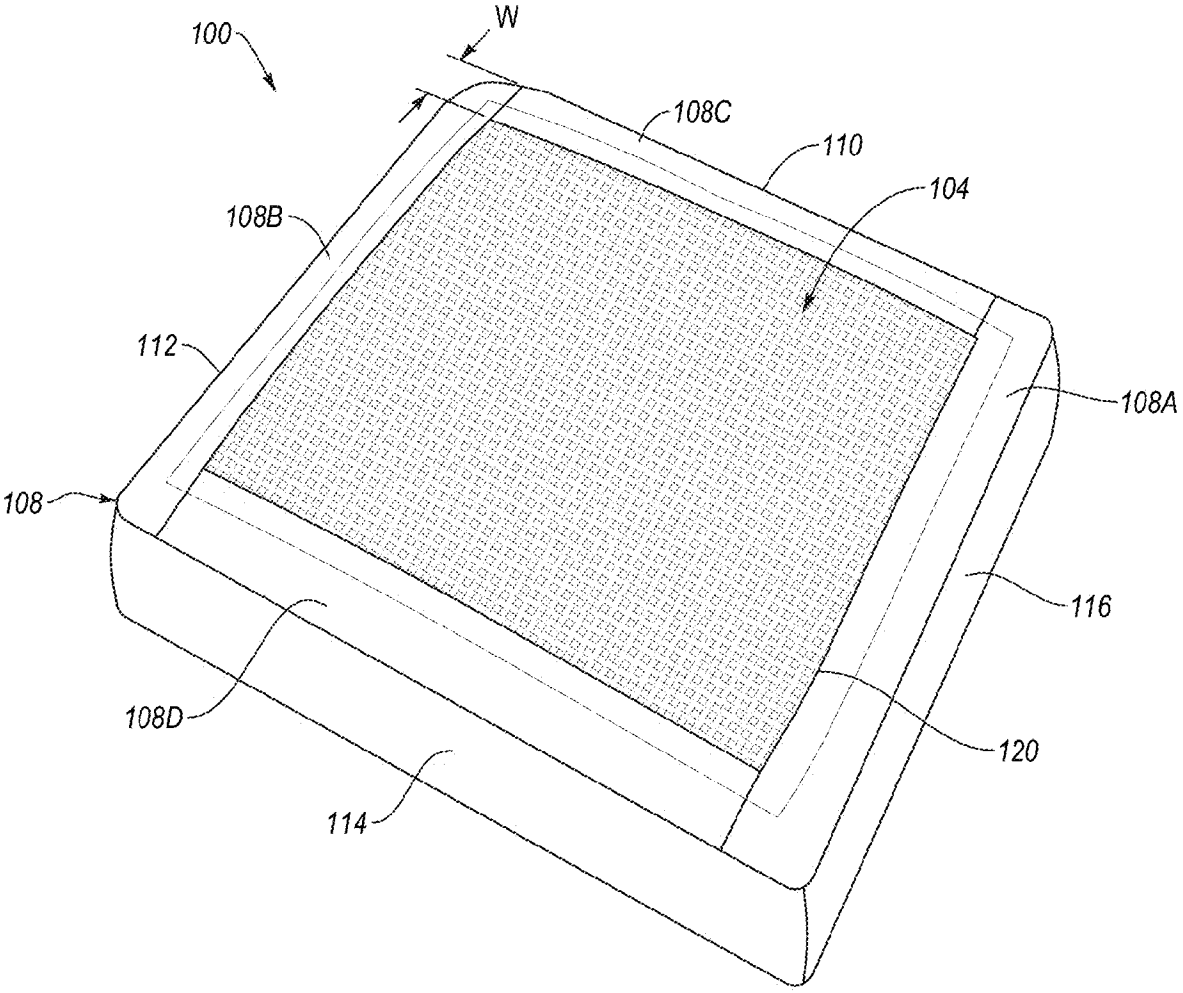
FIG. 2 illustrates a bottom perspective view of the cushion shown in FIG. 1.
Figure 3:
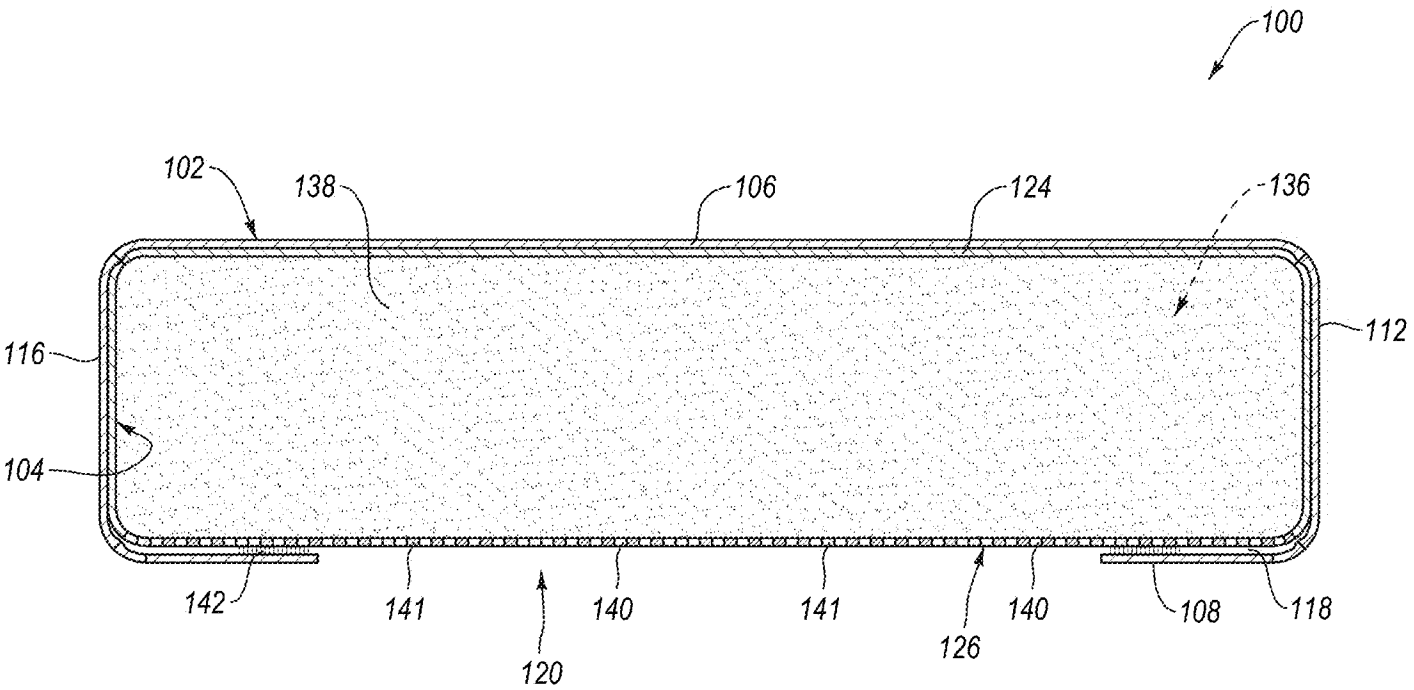
FIG. 3 illustrates a cross-sectional view of the cushion shown in FIG. 1 taken along line 3-3.

FIGS. 1 through 3 illustrate a top view, a bottom view, and cross-sectional view, respectively, of a cushion 100 according to an embodiment. The cushion 100 may include a cushion insert 104 and a cushion cover 102 sized and configured to selectively receive and house the insert 104. In an embodiment, the cushion 100 may be configured for use on an article of furniture. For example, the cushion 100 may be sized and/or shaped to be positioned on a bench, a folding lawn chair, a deck chair, a chaise lounge chair, a couch, a loveseat, a stool, a bed, or any other suitable article of indoor and/or outdoor furniture. However, it will be appreciated that in other embodiments the cushion 100 may be configured and/or utilized as a stand-alone unit (e.g., not associated with an article of furniture).

As described in more detail below, the cushion 100 may be configured to promote drying and/or draining of the cushion 100. The cushion 100 may also be configured to allow a user and/or a manufacturer to install and/or remove the cushion cover 102 and/or the insert 104 from the cushion 100 as desired. For example, in the event something is spilled on the cushion cover 102, the cushion cover 102 may be removed from the insert 104 for washing without having to wash the entire cushion 100, thereby helping to preserve the shape and/or volume of the cushion 100. In another embodiment, if a user's fashion preferences change, a user can exchange or swap the cushion cover 102 out for another cushion cover having a different color, texture, style, and/or design without having to repurchase the entire cushion 100. In other embodiments, the cushion 100 may be offered for sale with a plurality of cushion covers, each exhibiting a different color, design, or fashion. Accordingly, a user may have the ability to customize the cushion 100 as desired. In yet other embodiments, the cushion 100 may include cushion covers 102 and/or inserts 104 configured for use in different weather conditions. For example, in an embodiment, the cushion 100 may include a summer cushion cover 102 for use in the summer and a winter cushion cover 102 for use in the winter. Accordingly, a user may insert the insert 104 into one cushion cover 102 or another depending on the season. In other embodiments, if the cushion cover 102 and/or the insert 104 is damaged, the user may simply replace one or the other without having to purchase a whole new cushion 100.

In addition, the configuration of cushion 100 may help streamline inventory management. For example, in an embodiment, one or more inserts 104 may exhibit a standard and/or generic configuration. The cushion covers 102, on the other hand, may be customizable (i.e., including different colors, styles, designs, materials) and be manufactured and stored separate from the inserts 104. In an embodiment, the cushion covers 102 may be configured to be installed on the inserts 104 by an end user such that a manufacturer may produce, ship, and/or offer to sell a variety of different cushion covers 102 separately from the inserts 104. Such a configuration may help streamline the manufacturer's storage, inventory, and shipping costs.

Referring to FIGS. 1 through 3, the cushion cover 102 may exhibit any number of different configurations. For example, in the illustrated embodiment, the cushion cover 102 may include a generally planar square top portion 106, a bottom portion 108 (best shown in FIG. 2), and side portions 110, 112, 114, and 116. The side portions 110, 112, 114, and 116 may be connected to the top portion 106 and may extend generally downward therefrom. The side portions 110, 112, 114, and 116 may be connected to the top portion 106 in any suitable manner. For example, an upper edge portion of the side portions 110, 112, 114, and 116 may be connected an edge portion of the top portion 106 via stitching thereby forming one or more seams between the top portion 106 and the side walls 110, 112, 114, and 116. In other embodiments, the side portions 110, 112, 114, and 116 may be connected to the top portion 106 via adhesives, mechanical fasteners, clips, snaps, buttons, combinations thereof, or any other suitable type of connection. The bottom portion 108 may be connected to the side portions 110, 112, 114, and 116 generally opposite the top portion. Similar to the top portion 106, the bottom portion 108 may be connected to the side portions 110, 112, 114, and 116 in any suitable manner. For example, in the illustrated embodiment, a lower edge portion of the side portions 110, 112, 114, and 116 may be connected to an outer edge portion of the bottom portion 108 via stitching, thereby forming one or more seams between the bottom portion 108 and the side walls 110, 112, 114, and 116.

Together, the top portion 106, the side portions 110, 112, 114, and 116, and the bottom portion 108 may define an interior space 118 (shown in FIG. 3) within the cushion cover 102. As will be discussed in more detail below, the cushion 100 may be configured such that the insert 104 may be inserted and/or removed from the interior space 118 of the cushion cover 102 as desired. Thus, the cushion 100 may be customizable and/or modifiable by changing the cushion cover 102 and/or the insert 104 of the cushion 100.

In an embodiment, the interior space 118 may be sized and/or shaped to generally correspond to the size and/or shape of the insert 104. Such a configuration may help the cushion cover 102 fit the insert 104 so as to provide the appearance of an integral cover. In other embodiments, the cushion cover 102 may be fitted, semi-fitted, or non-fitted relative to the insert 104.

In an embodiment, the side portions 110, 112, 114, and 116 may comprise a single band-like member extending between the top portion 106 and the bottom portion 108. In other embodiments, the side portions 110, 112, 114, and 116 may comprise two, three, four, or any other suitable number of band-like members extending between the top portion 106 and the bottom portion 108. In other embodiments, the side portions 110, 112, 114, and 116 may comprise a plurality of fabric panels extending at least partially between the top portion 106 and the bottom portion 108. Optionally, the side portions 110, 112, 114, and 116 may be omitted. For example, in an embodiment, the top portion 106 may be connected to the bottom portion 108 to define the interior space 118.

In the illustrated embodiment, the bottom portion 108 may exhibit a generally border-like or frame-like configuration including an inner edge portion defining a generally square opening 120 into the interior space 118. The bottom portion 108 may include a first member 108A, a second member 108B, a third member 108C, and a fourth member 108D. In an embodiment, the first member 108A may extend along the lower edge portion of the side portion 116 between side portions 114 and 110. The second member 108B may extend along the lower edge of the side portion 112 between side portions 114 and 110. The third member 108C may extend along the lower edge portion of the side portion 110 between the first and second members 108A and 108B. The fourth member 108D may extend along the lower edge portion of the side portion 114 between the first and second members 108A and 108B.

As shown in FIG. 2, the bottom portion 108 may exhibit a width W defined between the opening 120 and the side portions 110, 112, 114, and 116. In an embodiment, the width W of the bottom portion 108 may vary between different portions of the bottom portion 108. For example, the width of member 108B may be greater than the width W of members 108A, 108C, and 108D. In other embodiments, the width of member 108A may be greater than the width of members 108C and 108D. In yet other embodiments, the width W of the bottom portion 108 may be generally constant.

In an embodiment, one or more portions of the bottom portion 108 may exhibit a width W of greater than about one (1) inch, about one and a half (1.5) inches, about two (2) inches, about three (3) inches, or about four inches (4). In other embodiments, one or more portions of the bottom portion 108 may exhibit a width W of between about one-half (0.5) inch and about four (4) inches, about one (1) inch and about two (2) inches, about one and a half (1.5) inches and about two and a half (2.5) inches, or about one (1) inch and about four (4) inches. In other embodiments, the width W may be greater or smaller.

The bottom portion 108 of the cushion cover 102 may be configured to help enhance the appearance and/or structure of the cushion 100. For example, the bottom portion 108 may interconnect the lower edge portions of the side portions 110, 112, 114, and 116 thereby reinforcing the cushion 100 against outward forces exerted by the insert 104. In other embodiments, the width W of the bottom portion 108 may be configured to promote the retention of the insert 104 within the cushion cover 102 by physically retaining one or more selected portions of the bottom face 126 of the insert 104 within the cushion cover 102.

In other embodiments, when the cushion 100 is positioned on an article of furniture or another support surface, the width of the bottom portion 108 may selected to help conceal the opening 120 of the cushion cover 102 as the cushion 100 shifts or moves under the weight of a user or an object. In addition, the width W of the bottom portion 108 may be configured to promote the appearance of an integral cover by covering selected portions of the bottom face 126 of the insert 104.

While the cushion cover 102 is illustrated exhibiting a generally square configuration, in other embodiments, the cushion cover 102 may exhibit a generally rectangular configuration, a generally cylindrical configuration, a generally irregular geometric configuration, or any other suitable shape. Further, while the top portion 104 is described being generally planar, in other embodiments, the top portion 104 may include one or more curved portions, one or more non-planar portions, planar and curved portions, combinations thereof, or any other suitable configuration. In some embodiments, the cushion cover 102 may include one or more pockets (not shown). For example, the top portion 106, the bottom portion 108, and/or the side portions 110, 112, 114, and 116 may include one or more pockets configured to store items such as care instructions, deodorizers, money, or the like on or within the cushion cover 102. In other embodiments, the pockets may be omitted.

Moreover, while the bottom portion 108 is shown including four members, in other embodiments, the bottom portion 108 may include one, two, three, five, six or any other suitable number of members. Further, while the members 108A and 108B are shown extending between side portions, in other embodiments, the members 108C and 108D may extend between the side portions 112 and 116. In other embodiments, the members 108A, 108B, 108C, and 108D may exhibit any suitable configuration. In addition, while the bottom portion 108 is shown exhibiting a frame-like configuration, in other embodiments, the bottom portion 108 may comprise a single member having one or more openings 120 cut or otherwise formed therein or any other suitable configurations. While a single opening 120 is shown, in other embodiments, the bottom portion 108 may define two, three, five, or any other suitable numbers of openings 120. Moreover, while the opening 120 is shown exhibiting a square-like configuration, in other embodiments, the opening may exhibit a generally rectangular configuration, a generally elliptical configuration, a generally oval configuration, an irregular geometric configuration, combinations thereof, or any other suitable shape. Moreover, while the cushion cover 102 is shown and described in connection with insert 104, in other embodiments, the cushion cover 102 may be sized and configured for use with different cushions and/or cushion inserts.

The cushion cover 102 may be formed of any suitable material. For example, one or more portions of the cushion cover 102 may be formed of one or more polyester materials. In other embodiments, one or more portions of the cushion cover 102 may include woven fabrics, cloth, canvas, polyamides, woven acrylics, wicker materials, plastic materials, burlap, hemp, composite materials, or any other suitable materials. Optionally, the side portions 110, 112, 114, and 116 may include one or more materials exhibiting a desired stiffness configured to help the cushion cover 102 maintain its shape. In other embodiments, the top portion 106 may include one or more materials exhibiting a selected softness or feel. Such a configuration may help accommodate for a user's anatomical characteristics and/or comfort preferences. In yet other embodiments, one or more portions of the cushion cover 102 may be treated. For example, in an embodiment, one or more portions of the cushion cover 102 may include one or more coats of waterproofing materials, stain resistant materials, deodorizing materials, ultra-violet protectants, combinations thereof, or any other suitable materials. Moreover, one or more portions of the cushion cover 102 may include any suitable number of layers. For example, in an embodiment, the cushion cover 102 may include an inner liner attached to an outer layer. In other embodiments, the cushion cover 102 may include one or materials exhibiting one or more different colors, textures, or designs.

Figure 4:
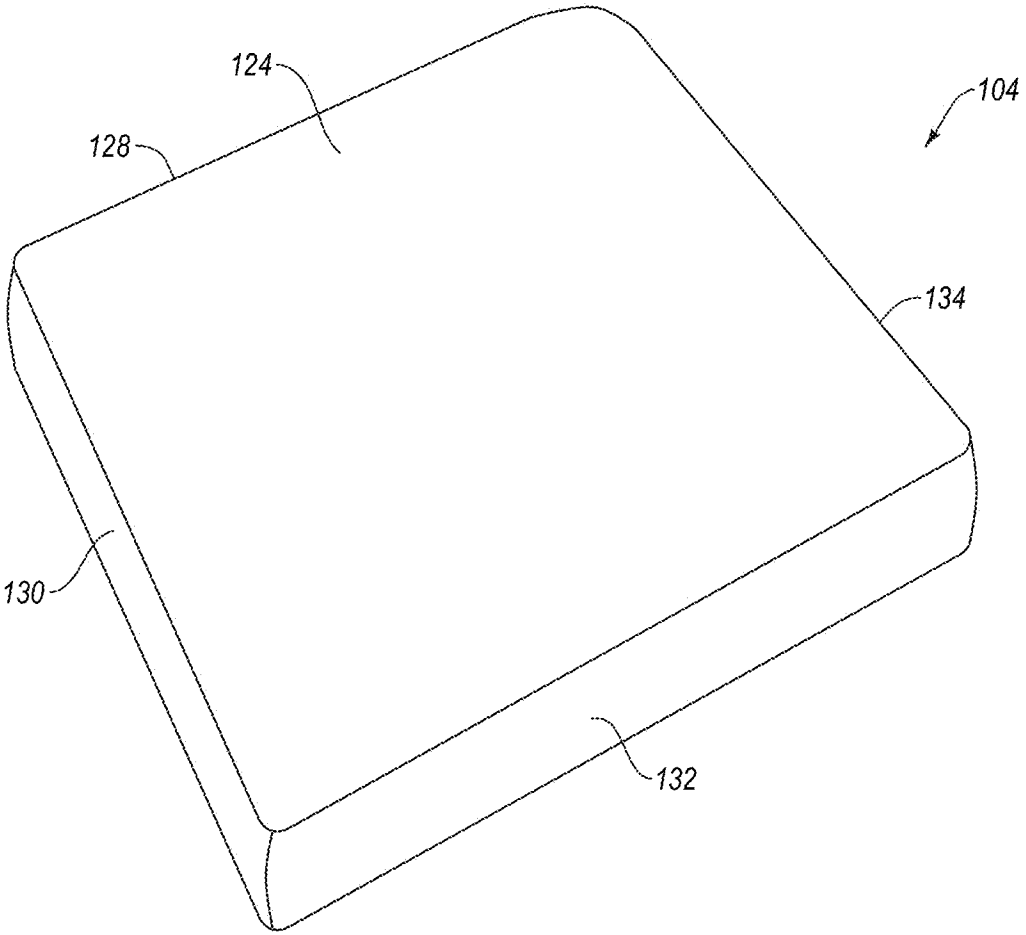
FIG. 4 illustrates a top perspective view of the insert shown in FIG. 1 removed from the cushion cover.

Referring now to FIGS. 3 and 4, the insert 104 may be sized and/or configured to be removably positioned within the interior space 118 of the cushion cover 102. For example, in an embodiment, the insert 104 may comprise a top portion or face 124, a bottom portion or face 126, and side portions 128, 130, 132, and 134 extending between the top face 124 and the bottom face 126. Together, the top face 124, the bottom face 126, and the side portions 128, 130, 132, and 134 may define an interior space 136 (shown in FIG. 3). Like the cushion cover 102, the insert 104 may be formed on any suitable materials. For example, in an embodiment, the insert 104 may include one or more polyester materials.

The insert 104 may further include one or more fill materials 138 positioned within the interior space 136. The one or more fill materials 138 may comprise any suitable fill materials. For example, in an embodiment, one or more of the fill materials may comprise foam, polyester fibers, poly fill, poly wrap, quilt-batting materials, down materials, gel materials, combinations thereof, or any other suitable fill material.

Optionally, the insert 104 may include a closable opening configured to provide access to the interior space 136. Such a configuration may allow a user to position, move, add, and/or remove the one or more fill materials from the interior space 136 through the closable opening in order to accommodate for the user's anatomical characteristics and/or comfort preferences and/or fashion preferences. In addition, the closeable opening may provide a user the ability to customize the type of fill material within the interior space 136. For example, in the event a user is allergic to feathers, a user may replace any features within the interior space 136 with poly fill, for instance, through the closable opening.

Figure 5:
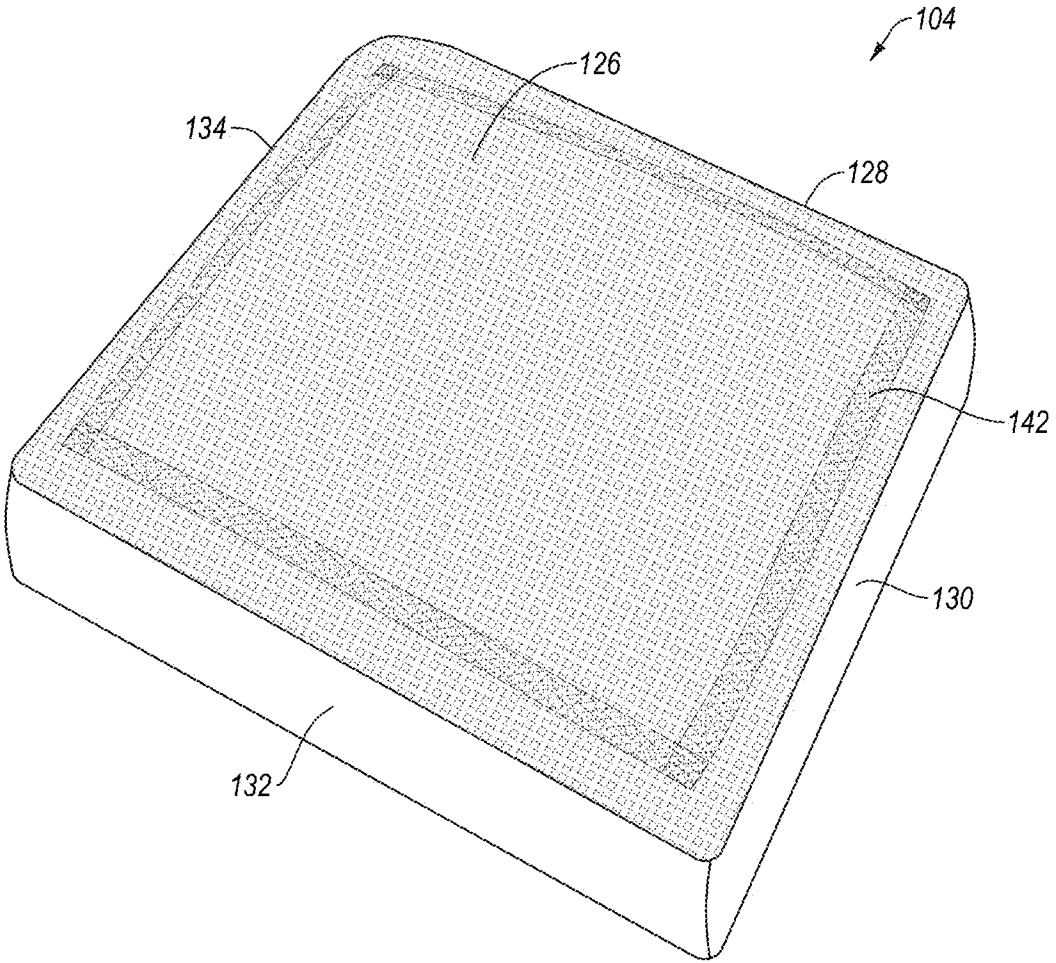
FIG. 5 illustrates a bottom perspective view of the insert shown in FIG. 4.
Figure 6:
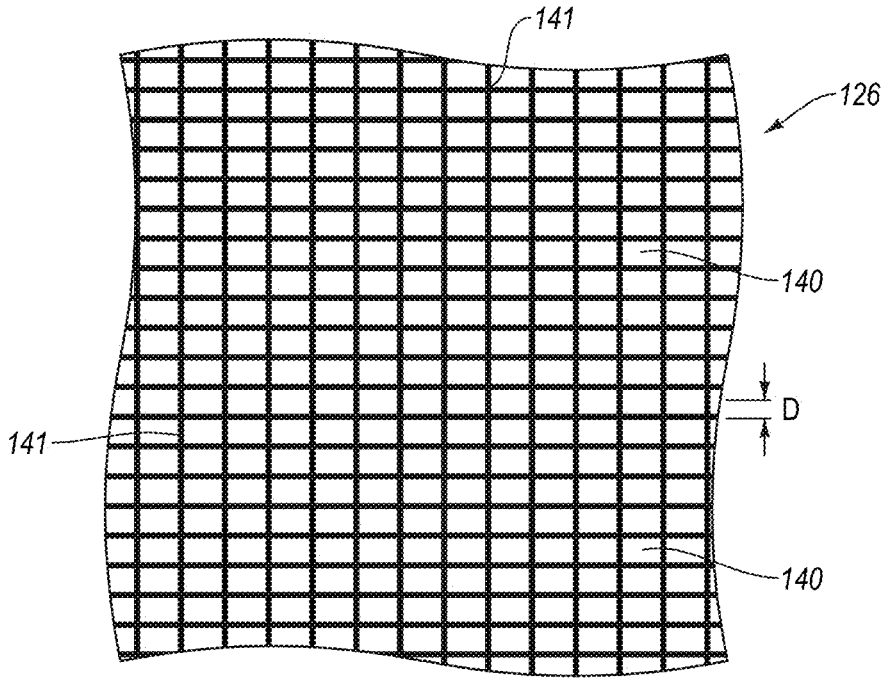
FIG. 6 illustrates a detailed bottom view of the insert shown in FIG. 5.

The cushion 100 may include one or more features configured to help the cushion 100 resist damage from spills, rain, and/or other weather conditions. For example, the bottom face 126 of the insert 104 may include one or more materials 141 having an interior surface, an exterior surface, and one or more pores, openings, and/or slots extending between the interior surface and the exterior surface. As shown in FIGS. 5 and 6, the bottom face 126 may comprise a mesh material 141 having a plurality of generally rectangular openings 140 extending therethrough.

In an embodiment, one or more of the openings 140 may exhibit a selected size configured to at least partially obstruct passage of the fill materials 138 therethrough. In other embodiments, one or more of the openings 140 may exhibit a selected size configured to at least partially allow passage of air, water, and/or other fluids or materials therethrough. For example, as shown in FIG. 6, one or more of the openings 140 may exhibit a selected lateral opening dimension D (e.g., a diameter) configured to help prevent the fill materials 138 from falling out through the bottom face 126 of the insert 104. The selected lateral opening dimension D may further be configured to promote drying and/or draining of the insert 104 by allowing air, water, and/or other fluids or materials to pass through the openings 140. In an embodiment, the lateral opening dimension D of one or more of the openings 140 may be greater than about 0.01 inches, greater than about 0.05 inches, greater than about 0.1 inches, greater than about 0.2 inches, greater than about 0.3 inches, greater than about 0.4 inches, greater than about 0.5 inches, or greater than about 1 inch. In other embodiments, the lateral opening dimension D of one or more of the openings 140 may be between about 0.01 inches and about 1 inch, between about 0.03 inches and about 0.75 inches, between about 0.1 inches and about 0.6 inches, between about 0.2 inches and about 0.5 inches, or between about 0.1 inches and 0.4 inches. In other embodiments, the lateral opening dimension D of one or more of the openings 140 may be larger or smaller. In the event cushion 100 is spilled upon or is left outside and becomes saturated with moisture, the lateral opening dimension D of one or more of the openings may help the cushion 100 dry out by allowing air to circulate through the openings 140 and the fill materials 138. The lateral opening dimension D of the one or more openings 140 may also promote draining and/or drying of the cushion insert 104 by allowing moisture in the fill materials 138 to drain out through the bottom face 126. Such a configuration may help extend the useful life of the cushion 100.

Figure 7:
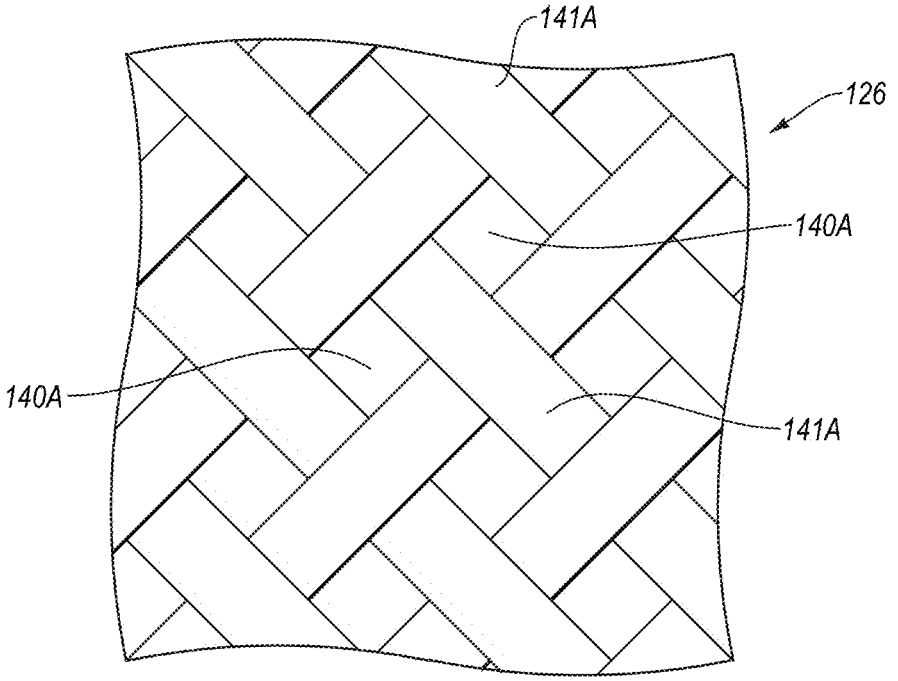
FIG. 7 illustrates a detailed bottom view of an insert according to another embodiment.
Figure 8:
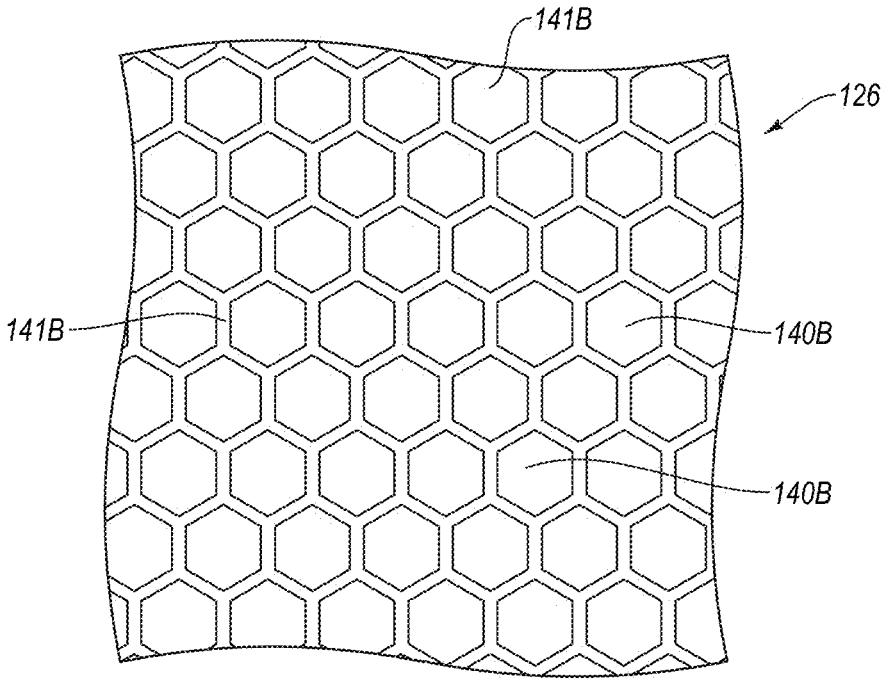
FIG. 8 illustrates a detailed bottom view of an insert according to another embodiment.
Figure 9:
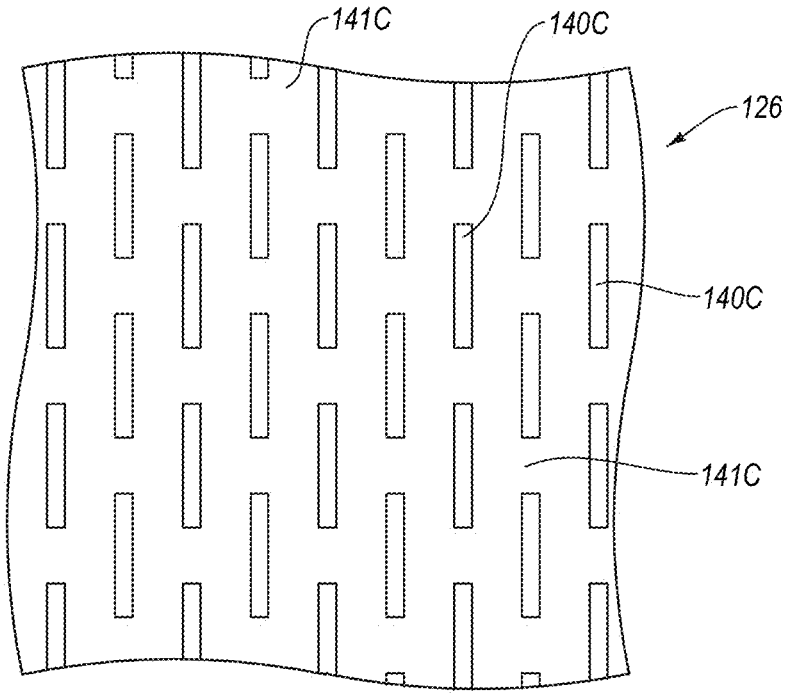
FIG. 9 illustrates a detailed bottom view of a insert according to another embodiment.

While the bottom face 126 of the insert 104 is shown comprising a mesh material, in other embodiments, the bottom face 126 of the insert 104 may include one or more woven materials, perforated materials, honeycomb materials, combinations thereof, or any other suitable materials. For example, in an embodiment, a first portion of the bottom face 126 may comprise a poly-vinyl-chloride (PVC) mesh material and a second portion of the bottom face 126 may comprise a polyester material. In other embodiments, as shown in FIG. 7, at least a portion of the bottom face 126 may comprise a woven material 141A having through openings 140A. Such a configuration may influence the tensile, flexural, and/or compressive properties of the bottom face 126. In yet other embodiments, as shown in FIG. 8, at least a portion of the bottom face 126 may comprise one or more materials 141B having a honeycomb type structure including through openings or cells 140B. Such a configuration may influence the strength of the bottom face 126. In addition, the shape and/or size of the through openings or cells 140B may influence the passage of fluids and/or materials through the openings or cells 140B. In still other embodiments, as shown in FIG. 9, at least a portion of the bottom face 126 may comprise one or more materials 141C having one or more through slots 140C formed therein. Such a configuration may influence the tensile, flexural, and/or compressive properties of the bottom face 126. In addition, the shape and size of the slots 140C may influence the passage of fluids and/or materials through the slots 140C. Moreover, while the bottom face 126 is shown in FIG. 6 including generally rectangular openings 140, in other embodiments, the size, shape, and/or configuration of the openings 140 may vary. For example, in an embodiment, the bottom face 126 may include one or more openings 140 that are larger than other ones of the openings 140. In yet other embodiments, a portion of the openings 140 may exhibit an elliptical-like configuration and another portion of the openings 140 may exhibit an elongated slot configuration.

Referring again to FIG. 2, the opening 120 of the cushion cover 102 and the bottom face 126 of the insert 104 collectively may be configured to promote drying and/or draining of the cushion 100 by exposing at least a select portion of the through openings 140 to an area external to the cushion cover 102 and/or the cushion 100. In an embodiment, the opening 120 may have an area greater than about forty (40) percent, about fifty (50) percent, about sixty (60) percent, about seventy (70) percent, about eighty (80) percent, about ninety (90) percent, or about ninety-five (95) percent of the area of the bottom face 126 of the insert 104. In other embodiments, the opening 120 may have an area between about thirty (30) percent and about ninety-five (95) percent, between about forty (40) percent and ninety (90) percent, between about seventy (70) percent and about ninety (90) percent, between about fifty (50) percent and about eighty (80) percent, or between about sixty (60) percent and about seventy (70) percent. Accordingly, the opening 120 of the cushion cover 102 and the bottom face 126 of the cushion insert 104 may collectively allow a desired amount of heat, air, water, other materials or fluids, or the like to pass between the fill materials 138 and the environment and/or a support surface through the opening 120 and/or the through openings 140 of the cushion insert 104. Such a configuration may help the cushion 100 resist damage and saturation from spills, rain, other weather conditions, and/or the like.

Figure 10:
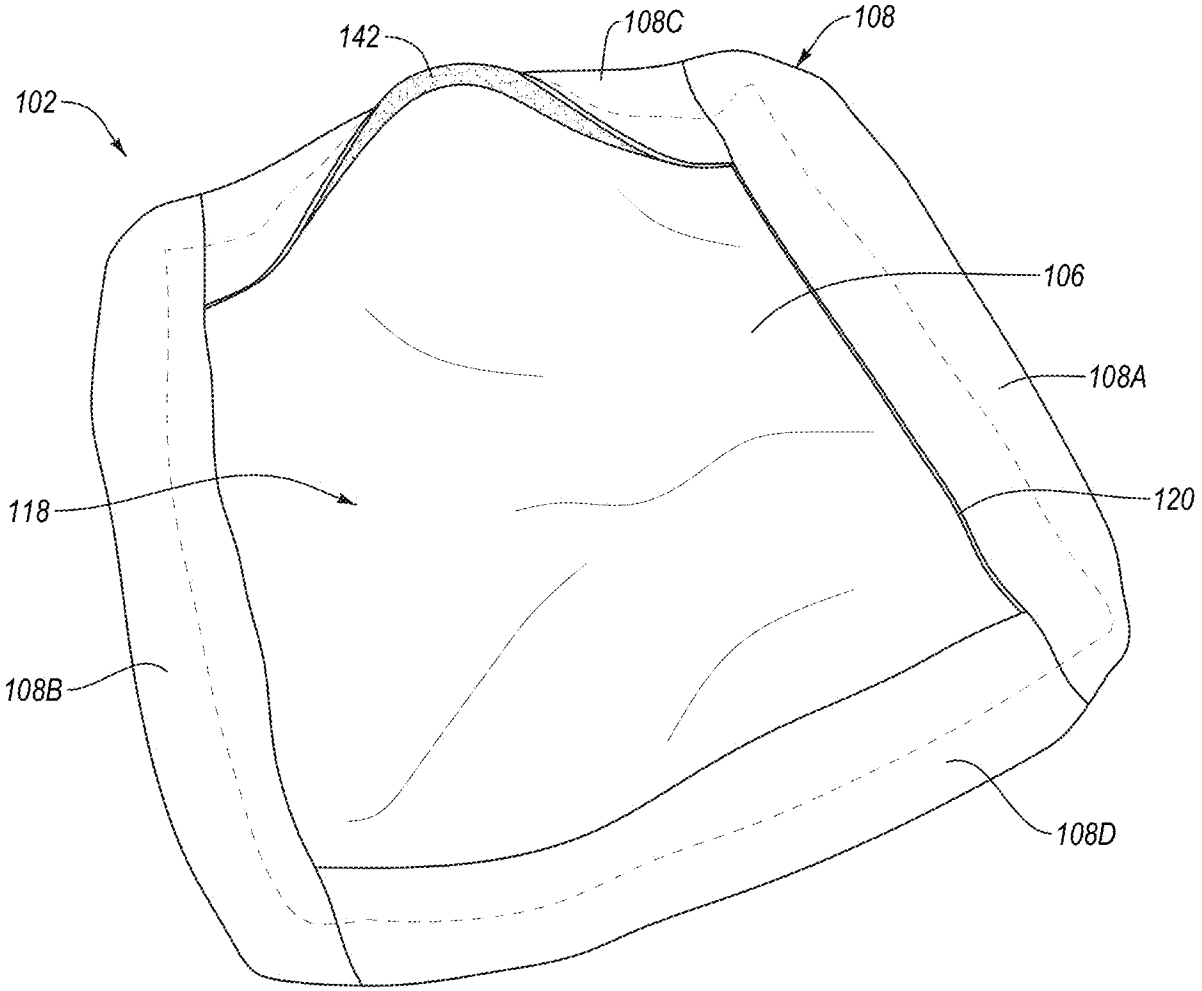
FIG. 10 illustrates a bottom perspective view of the cushion cover shown in FIG. 1.

Optionally, the cushion 100 may include one or more features configured to help retain or secure the insert 104 in the cushion cover 102. For example, in an embodiment, the cushion 100 may include a securing system comprising a hook-and-loop fastener system 142 (e.g., VELCRO®) to help retain or secure the insert 104 in the cushion cover 102. As shown in FIG. 5, the bottom face 126 of the insert 104 may include one or more strips of the hook portion of the system 142. As shown in FIG. 10, the interior surface of the side portions 110, 112, 114, and 116 may include one or more strips of the loop portion of the system 142. To help retain the insert 104 within the interior space 118 of the cushion cover 102, a user may connect the one or more hook portions of the system 142 attached to the insert 104 to the one or more loop portions of the system 142 attached to the cushion cover 102.

While the insert 104 is described including the one or more hook portions of system 142 and the cushion cover 102 is described including the one or more loop portions, it will be appreciated that the insert 104 may include the one or more loop portions of the system 142 and the cushion cover 102 may include the one or more hook portions of the system 142. Moreover, while the cushion 100 is shown in FIGS. 5 and 10 including a hook-and-loop fastener system, in other embodiments, the cushion 100 may include zippers, magnets, snaps, clips, buttons, adhesives, mechanical fasteners, combinations thereof, or any other suitable securing system.

Figure 11A:
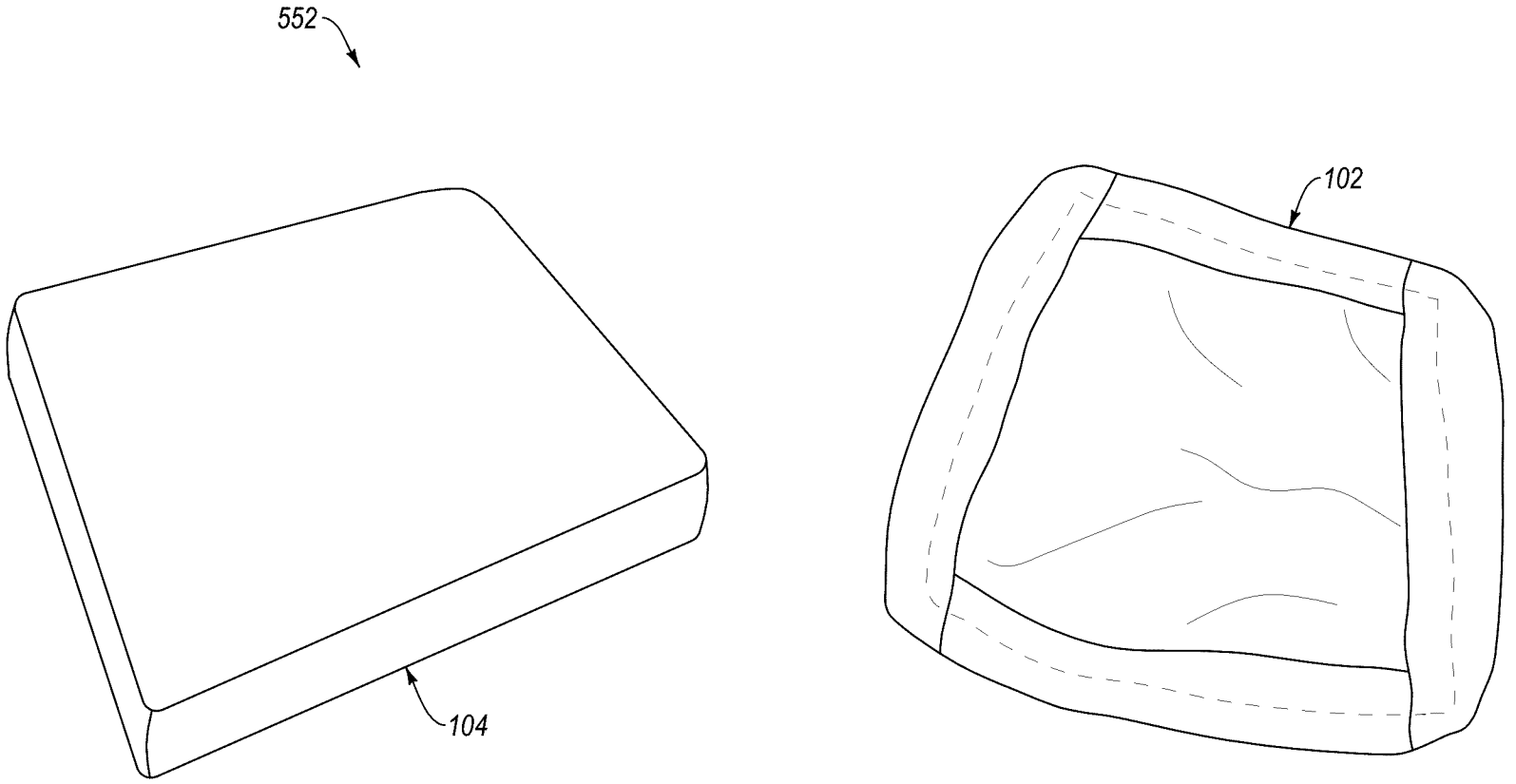
FIGS. 11A through 11D illustrate steps for assembling a cushion according to an embodiment.
Figure 11B:
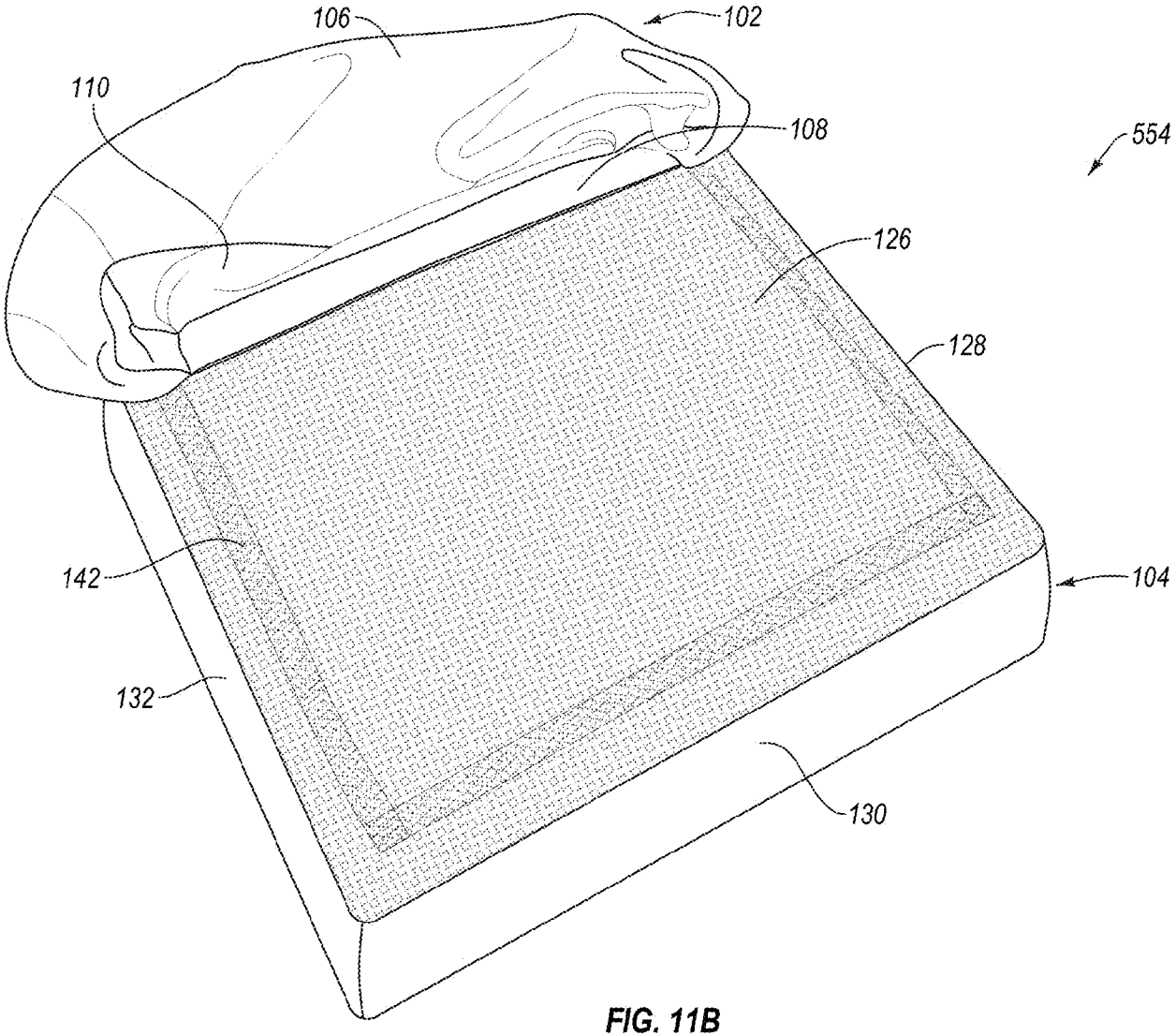
Figure 11C:
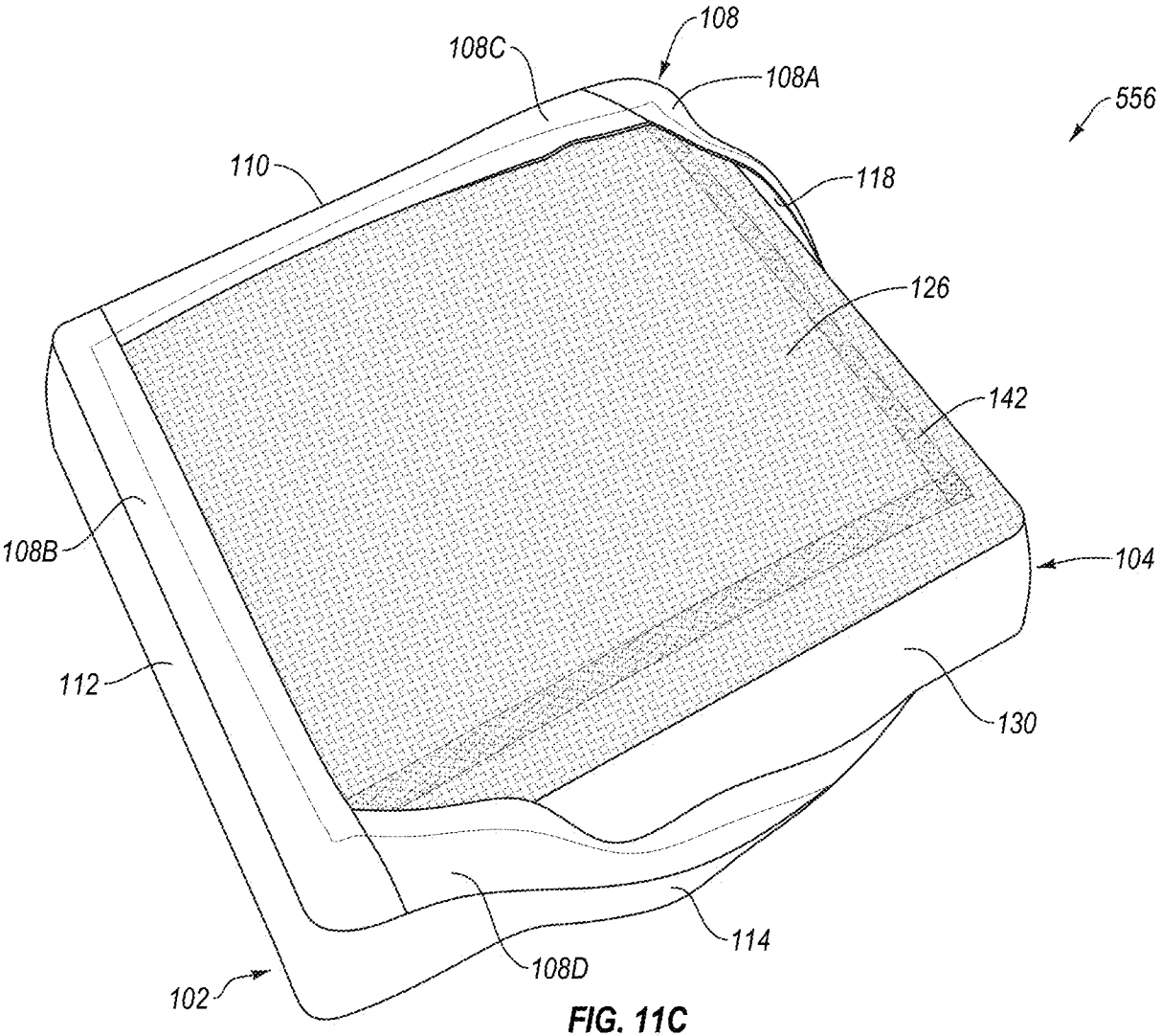
Figure 11D:
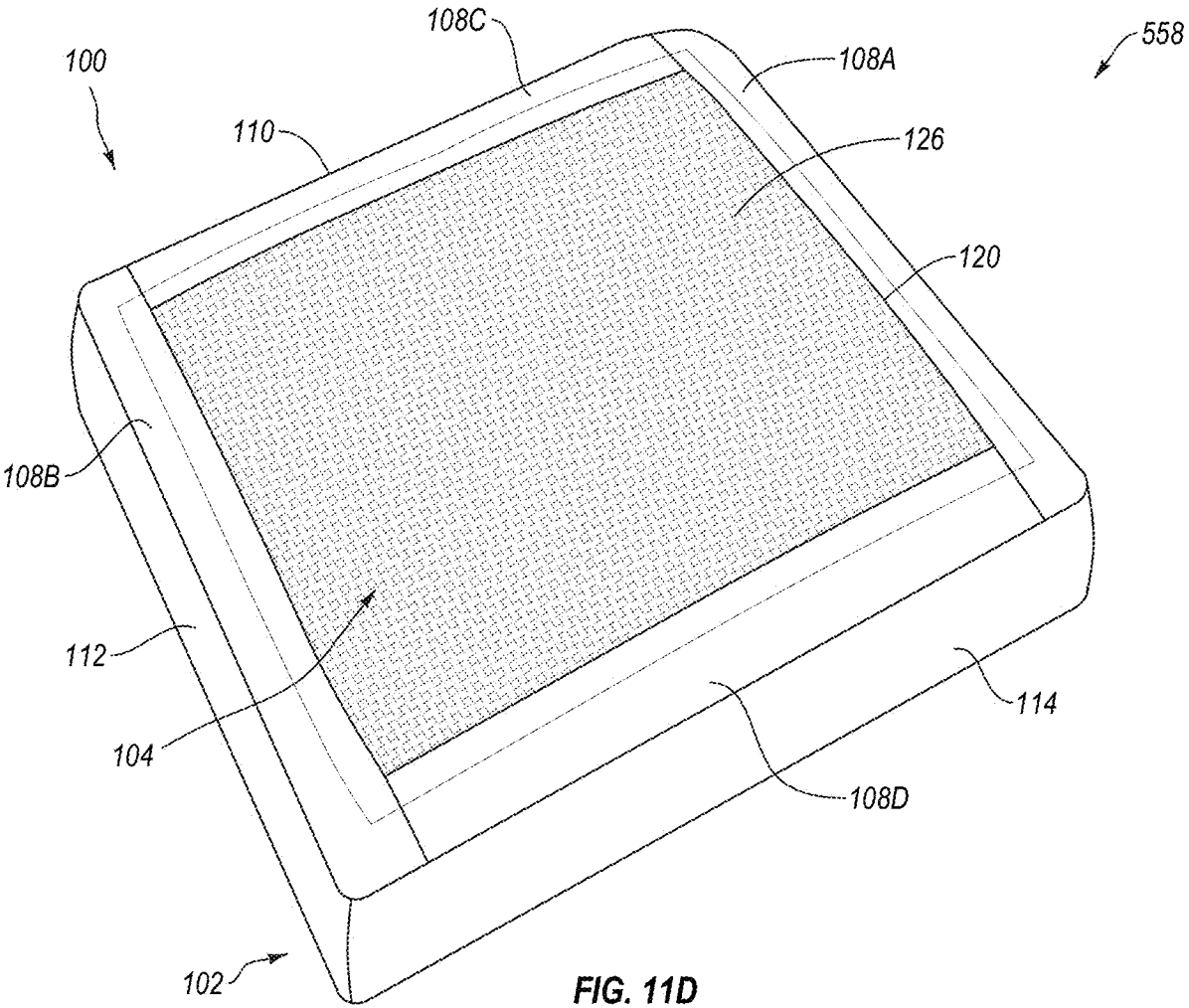
Figure 15:
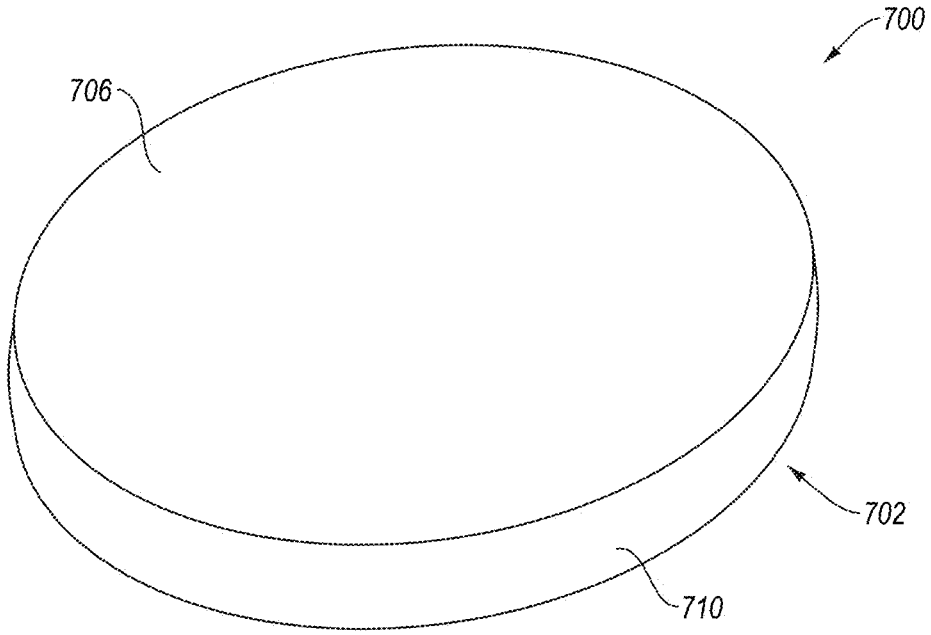
FIG. 15 illustrates a top perspective view of a cushion according to another embodiment.
Figure 16:
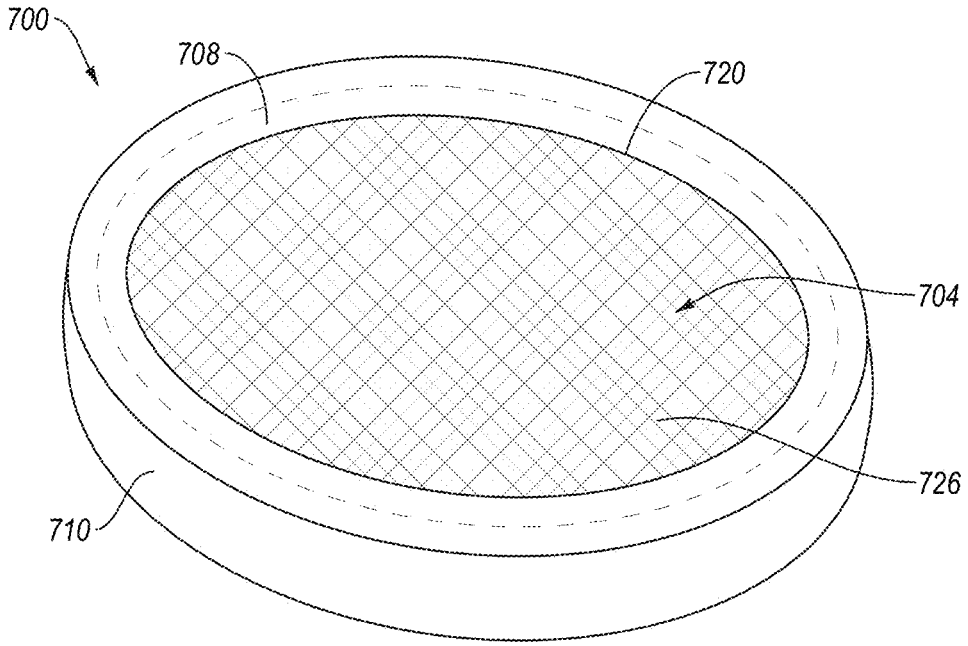
FIG. 16 illustrates a bottom perspective view of the cushion shown in FIG. 15.
Figure 17:
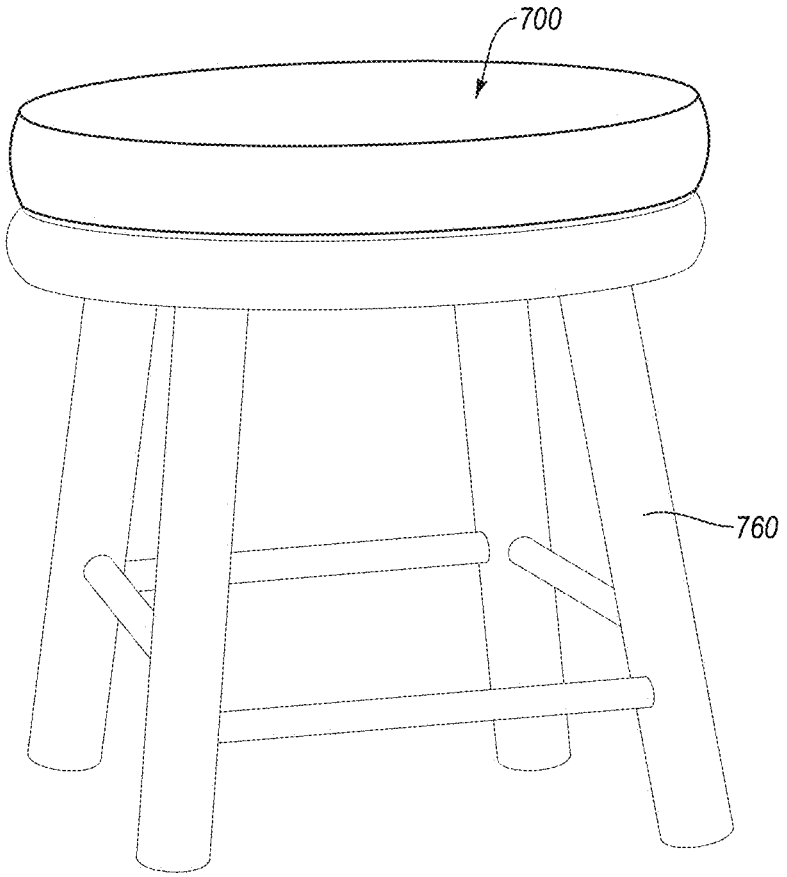
FIG. 17 illustrates a top perspective view of the cushion shown in FIG. 15 positioned on an article of furniture.

FIGS. 11A through 11D illustrates a method 500 of assembly the cushion 100 according to an embodiment. While the method 500 is illustrated using cushion 100, it will be appreciated that the cushion may be any cushion disclosed herein, such as cushion 600 (FIGS. 12-14) and cushion 700 (FIGS. 15-17). The method 500 includes an act 552 of providing the cushion cover 102 and the insert 104 as shown in FIG. 11A. Next, the method 500 includes an act 554 of positioning at least a portion of the bottom portion 108 and a side portion (e.g., 110) of the cushion cover 102 on a side portion of the insert 104. As shown in FIG. 11B, positioning the cushion cover 102 on the end portion of the insert 104 may facilitate the connection of at least a portion of the hook-and-loop fastener system 142 of the cushion 100 between the cushion cover 102 and the insert 104. Next, the method 500 may include an act 556 of moving or pulling the top portion 106, the side portions 110, 112, 114, and 116 and/or a part of the bottom portion 108 of the cushion cover 102 over the top face 124, side portions 128, 130, 132, and 134, and a portion of the bottom face 126 of the insert 104 in manner such that the insert 104 is substantially positioned within the interior space 118 of the cushion cover 102. The opening 120 may be configured to provide access to the interior space 118. For example, the opening 120 may be configured to allow insertion of the insert 104 into the interior space 118 and/or removal of the insert 104 from the interior space 118 (shown in FIG. 11C). Next, the method 500 may include an act of 558 of pulling or positioning any remaining portions of the bottom portion 108 over the bottom face 126 of the insert 104. As shown in FIG. 11D, the opening 120 of the cushion cover 102 may be positioned over the bottom face 126 of the insert 104 so as to leave a select number of the through openings 140 of the insert 104 substantially uncovered by the cushion cover 102. Thus, the opening 120 of the cushion cover 102 and the bottom face 126 of the insert 104 may collectively promote drying and/or draining of the cushion 100. In act 558, the hook-and-loop fastener system 142 may be connected between the insert 104 and the cushion cover 102 such that the insert 104 may be selectively secured within the cushion cover 102. Optionally, method 500 may further include the act of positioning or placing the cushion 100 on an article of furniture (e.g., chair, bench, ottoman, couch, or the like). It will be appreciated that method 500 may be performed by an end user and/or manufacturer of the cushion 100. In the event that a user or manufacturer desires to remove the insert 104 from the cushion cover 102, the steps of method 500 may be generally performed in reverse order.

Figure 12:
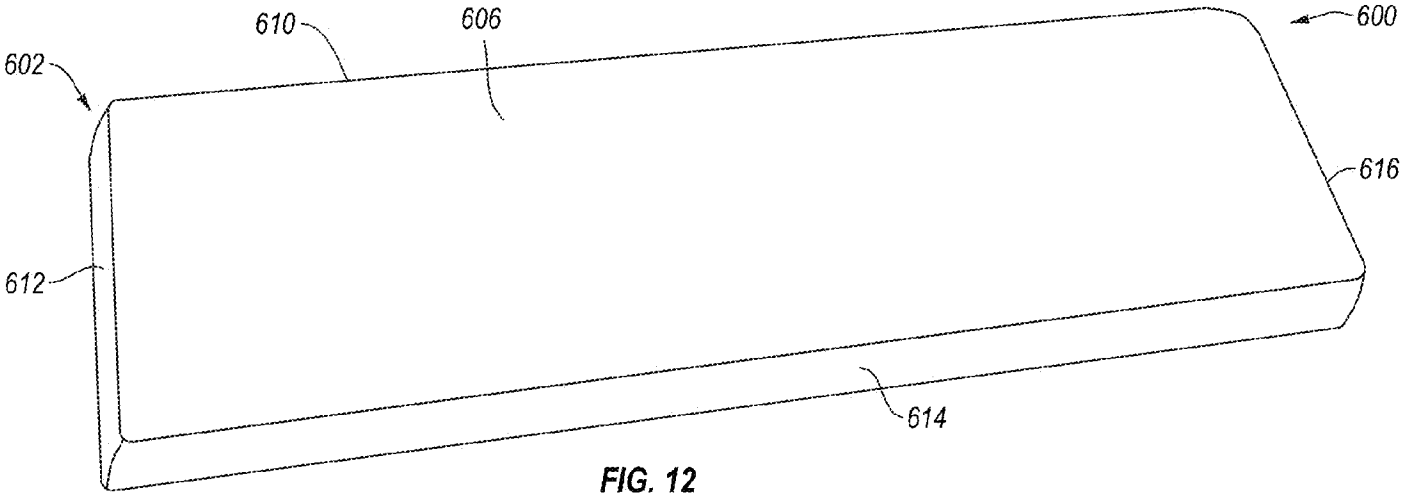
FIG. 12 illustrates a top perspective view of a cushion according to another embodiment.
Figure 13:
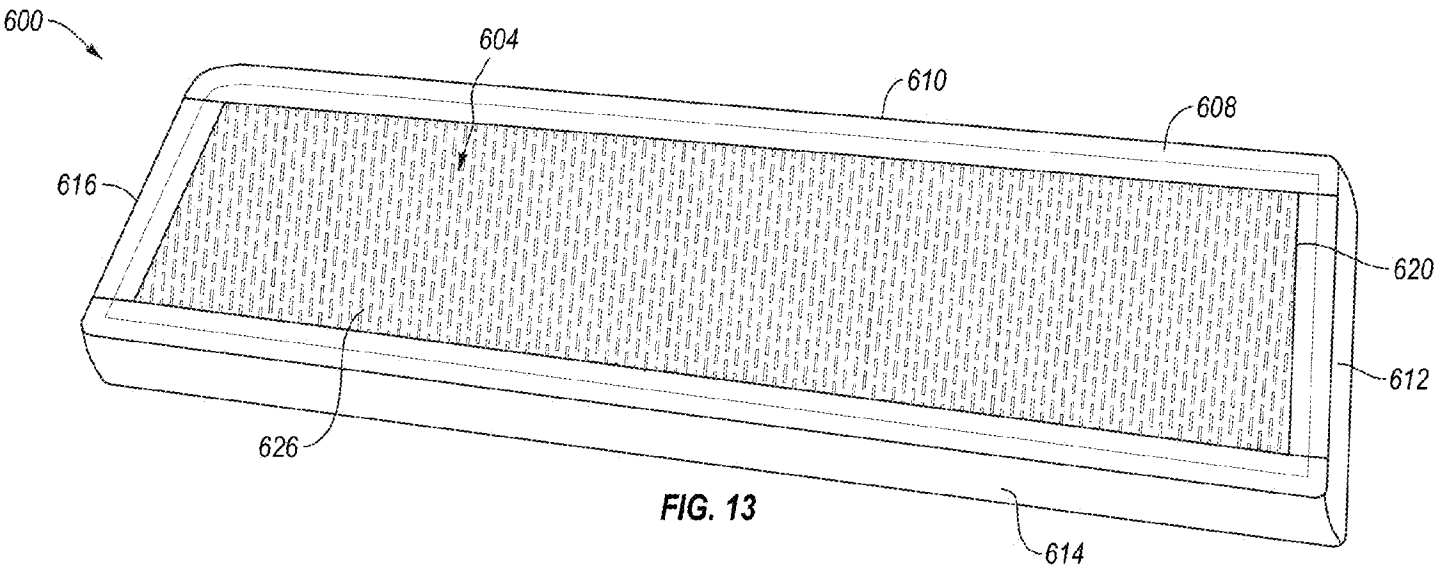
FIG. 13 illustrates a bottom perspective view of the cushion shown in FIG. 12.
Figure 14:
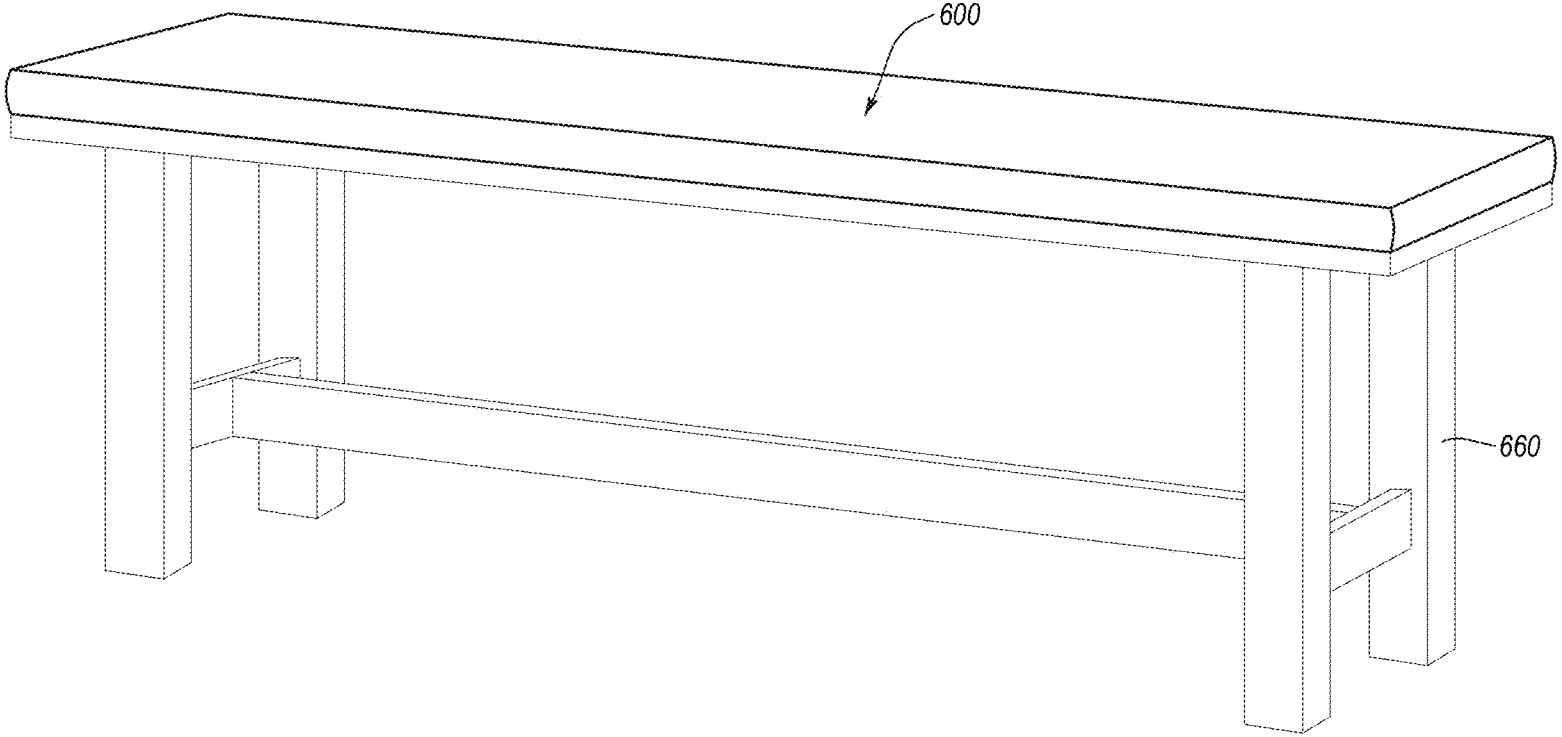
FIG. 14 illustrates a top perspective view of the cushion shown in FIG. 13 positioned on an article of furniture.

FIGS. 12 through 14 illustrate a cushion 600 according to another embodiment. The cushion 600 has many of the same components and features that are included in the cushion 100 of FIGS. 1 through 11D. Therefore, in the interest of brevity, the components and features of the cushions 100 and 600 that correspond to each other have been provided with identical reference numbers, and an explanation thereof will not be repeated. However, it should be noted that the principles of the cushion 600 may be employed with any of the embodiments described in relation to FIGS. 1-11D and vice versa.

The cushion 600 may include an insert 604 and a cushion cover 602 sized and configured to selectively receive and house the insert 604 within the cushion cover 602. In an embodiment, the cushion cover 602 may exhibit a generally rectangular configuration including a top portion 606, a bottom portion 608 (shown in FIG. 13), and side portions 610, 612, 614, and 616. As shown, the side portions 610, 612, 614, and 616 may extend between the top portion 606 and bottom portion 608. Like the side portions of cushion 100, the side portions 610, 612, 614, and 616 may be connected between the top and bottom portions 606, 608 by any suitable type of connection. Together, the top portion 606, the side portions 610, 612, 614, and 616, and the bottom portion 608 may define an interior space within the cushion cover 602. The bottom portion 608 may include an inner edge portion defining an opening 620 into the interior space. The insert 604 may be sized and configured to be selectively positioned within the interior space of the cushion cover 602. Moreover, like the insert 104, the insert 604 may include a bottom face 626 including one or more materials having one or more pores, openings, and/or slots extending therethrough.

As shown, the opening 620 of the cushion cover 602 may be sized and configured so as to expose a substantial portion of the openings in the bottom face 626 of the insert 604. Thus, water, for example, may pass from fill materials within the insert 604 to the environment and/or the support surface through the opening 620 of the cushion cover 602 and the openings of the bottom face 626. Accordingly, the cushion cover 602 and the bottom face 626 of the insert 604 may collectively promote drying and/or draining of the cushion 600. In addition, like cushion 100, the cushion 600 may be configured so as to allow a user and/or a manufacture to install and/or remove the cushion cover 602 and/or the insert 604 from the cushion 600 as desired.

Like cushion 100, the cushion 600 may be configured for use on an article of furniture. For example, as shown in FIG. 14, the cushion 600 may be sized and/or shaped to be positioned on a bench 660. While cushion 600 is shown on the bench 660, in other embodiments, the cushion 600 may be sized and/or shaped for use with a folding lawn chair, a deck chair, a chaise lounge chair, a couch, a loveseat, a stool, a bed, or any other suitable article of outdoor and/or indoor furniture. In other embodiments, the cushion 600 may be configured and/or utilized as a stand-alone unit (e.g., not associated with an article of furniture).

FIGS. 15 through 17 illustrate a cushion 700 according to another embodiment. The cushion 700 has many of the same components and features that are included in the cushions 100 and 600 of FIGS. 1 through 14. Therefore, in the interest of brevity, the components and features of the cushions 100, 600, and 700 that correspond to each other have been provided with identical reference numbers, and an explanation thereof will not be repeated. However, it should be noted that the principles of the cushion 700 may be employed with any of the embodiments described in relation to FIGS. 1-14 and vice versa.

As shown, the cushion 700 may exhibit a generally cylindrical configuration and may include an insert 704 and a cushion cover 702 sized and configured to selectively receive and house the insert 704 within the cushion cover 702. In an embodiment, the cushion cover 702 may include a top portion 706, a bottom portion 708 (shown in FIG. 16), and a side portion 710. As shown, the side portion 710 may extend between the top portion 706 and bottom portion 708. Like the side portions of cushion 100, the side portion 710 may be connected between the top and bottom portions 706, 708 by any suitable type of connection. Together, the top portion 706, the side portion 710, and the bottom portion 708 may define an interior space within the cushion cover 702. The bottom portion 708 may include an inner edge portion defining an opening 720 into the interior space.

The insert 704 may be sized and configured to be selectively positioned within the interior space of the cushion cover 702. Moreover, like the insert 104, the insert 704 may include a bottom face 726 including one or more materials having one or more pores, openings, and/or slots extending therethrough. As shown, the opening 720 of the cushion cover 702 may be sized and configured so as to expose a substantial portion of the openings in the bottom face 726 of the insert 704 to the environment and/or a support surface. Thus, air, for example, may pass between fill materials within the insert 704 and the environment and/or the support surface through the opening 720 of the cushion cover 702 and the openings of the bottom face 726. In addition, like cushion 100, the cushion 700 may be configured so as to allow a user and/or a manufacture to install and/or remove the cushion cover 702 and/or the insert 704 from the cushion 700 as desired.

Like the cushion 100, the cushion 700 may be configured for use on an article of furniture. For example, as shown in FIG. 17, the cushion 700 may be sized and/or shaped to be positioned on a stool 760. While cushion 700 is shown on the stool 760, in other embodiments, the cushion 700 may be sized and/or shaped for use with a folding lawn chair, a deck chair, a chaise lounge chair, a couch, a bench a loveseat, an ottoman, a bed, or any other suitable article of outdoor and/or indoor furniture. In other embodiments, the cushion 700 may be configured and/or utilized as a stand-alone unit (e.g., not associated with an article of furniture).

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A cushion system comprising:

an interchangeable cushion cover including:

a top portion;

a band portion extending downwardly from the top portion, the band portion including a top edge portion attached to the top portion and a bottom edge portion;

a bottom portion extending radially inward from the band portion, the bottom portion including an outer edge portion attached to the bottom edge of the band portion and an inner edge portion radially inside of the outer edge portion, the bottom portion substantially reinforcing at least the bottom edge portion of the band portion against radially outward movement;

an interior space having a bottom opening defined by the inner edge portion of the bottom portion a cushion insert removably positioned within the interior space of the cushion cover via the bottom opening, the cushion insert including a bottom face defining a network of through openings, the through openings and bottom opening of the cushion cover collectively arranged to promote at least one drying and draining of the cushion insert within the interior space of the cushion cover; and a releasable fastener system including a first part attached to atop surface of the bottom portion of the cushion cover, and a second part attached to the bottom face of the cushion insert and covering at least a portion of the through openings, the first part engaging the second part to releasably secure the cushion insert within the interior space.

2. The system of claim 1, wherein one or more of the through holes exhibit a selected lateral opening dimension configured to allow passage of at least one of air or water between an interior surface and an exterior surface of the cushion insert.

3. The system of claim 2, wherein the bottom face of the removable cushion insert includes one or more materials having a honeycomb structure.

4. The system of claim 2, wherein the bottom face of the removable cushion insert includes one or more woven materials.

5. The system of claim 2, wherein the selected lateral opening dimension of one or more of the through openings is greater than about one hundredth (0.01) inches, about five hundredths (0.05) inches, about one tenth (0.1) inches, about three tenths (0.3) inches, about five tenths (0.5) inches, or about one (1) inch.

6. The system of claim 1, wherein the interchangeable cushion cover includes at least one of a polyester material, a canvas material, or a plastic material.

7. The system of claim 1, wherein the releasable fastener system comprises a hook-and-loop fastener system.

8. The system of claim 1, wherein the releasable fastener system includes at least one of a magnet, a snap, or a clip.

9. The system of claim 1, wherein the interchangeable cushion cover is interchangeable with different cushion covers adapted for different weather conditions.

10. A method of assembling a cushion system, the method comprising:

providing an interchangeable cushion cover, the cushion cover including:

a top portion;

a band portion extending downwardly from the top portion, the band portion including a top edge portion attached to the top portion and a bottom edge portion;

a bottom portion extending radially inward from the band portion, the bottom portion including an outer edge portion attached to the bottom edge portion of the band portion and an inner edge portion radially inward from the outer edge portion, the bottom portion substantially reinforcing at least the bottom edge portion of the band portion against radially outward movement; and an interior space having a bottom opening defined by the inner edge portion of the bottom portion;

inserting a cushion insert in the interior space via the bottom opening, the cushion insert including a bottom face defining a network of through openings arranged to promote at least one drying and draining of the cushion insert within the interior space; and releasably securing the cushion insert within the interior space via a releasable fastener system, the releasable fastener system including a first part attached to a top surface of the bottom portion of the cushion cover, and a second part attached to the bottom face of the cushion insert and covering at least a portion of the through openings, the first part releasably engaging the second part.

11. The method of claim 10, wherein the interchangeable cushion cover comprises a first interchangeable cushion cover, and further comprising:

removing the cushion insert from the interior space of the first interchangeable cushion cover via the bottom opening of the first interchangeable cushion cover; and positioning the cushion insert in a second interchangeable cushion cover via a bottom opening formed in the second interchangeable cushion cover, wherein the first interchangeable cushion cover is different from the second interchangeable cushion cover.

* * * * *